US005785198A

United States Patent [19]

Credle, Jr.

[11] Patent Number: 5,785,198

[45] Date of Patent: Jul. 28, 1998

[54] TWIST-OFF CAN END

[75] Inventor: William S. Credle, Jr., Stone Mountain, Ga.

[73] Assignee: The Coca-Cola Company, Atlanta, Ga.

[21] Appl. No.: 529,578

[22] Filed: Sep. 18, 1995

[51] Int. Cl.[6] ..... B65D 51/18

[52] U.S. Cl. ..... 220/254; 220/269; 220/304; 220/319; 220/906

[58] Field of Search ..... 220/254, 269, 220/304, 319, 906; 215/252, 276

[56] References Cited

U.S. PATENT DOCUMENTS

| | | | |
|---|---|---|---|
| 803,932 | 11/1905 | Smelker | 215/276 |
| 2,562,111 | 7/1951 | Michel | 220/319 X |
| 3,899,096 | 8/1975 | Marco . | |
| 4,044,917 | 8/1977 | Vella . | |
| 4,111,330 | 9/1978 | Jordan | 220/306 |
| 4,159,061 | 6/1979 | Cornelius et al. | 215/255 |
| 4,316,318 | 2/1982 | Mineo . | |
| 4,408,694 | 10/1983 | Mueller . | |
| 4,694,970 | 9/1987 | Hayes | 215/252 |
| 4,705,183 | 11/1987 | Moloney | 215/276 |
| 4,782,968 | 11/1988 | Hayes | 215/276 |
| 4,844,270 | 7/1989 | Coffman . | |
| 4,932,554 | 6/1990 | Smith et al. . | |
| 5,052,568 | 10/1991 | Simon . | |
| 5,052,576 | 10/1991 | Büdenbender . | |
| 5,259,526 | 11/1993 | Stolzman . | |
| 5,341,949 | 8/1994 | Hayes . | |
| 5,421,473 | 6/1995 | McCrossen | 220/319 |

FOREIGN PATENT DOCUMENTS

| | | | |
|---|---|---|---|
| 698872 | 2/1931 | France . | |
| 1565643 | 5/1969 | France | 215/276 |
| 2563500 | 10/1985 | France . | |
| 914712 | 11/1953 | Germany . | |
| 3207172 | 9/1983 | Germany . | |
| 8701071 | 1/1988 | Germany . | |
| 93/01988 | 2/1993 | WIPO . | |

*Primary Examiner*—Stephen Cronin

*Attorney, Agent, or Firm*—Birch, Stewart, Kolasch & Birch, LLP

[57] ABSTRACT

A twist-off can end assembly includes a cylindrical can body having an open end with a rolled flange extending around an exterior surface of the can body at the open end and a shoulder portion joining the open end with side walls of the cylindrical can. A collar surrounds the exterior surface of the can adjacent the open end, the collar including a can mating finish of an inner surface thereof and a closure engaging finish on an outer surface thereof. The collar is seated against the exterior surface of the open end between the rolled flange and the shoulder portion of the can body. A cylindrical closure is provided having a dependent peripheral skirt for operatively engaging the closure engaging finish of the collar. A lid member is secured to the open end of the cylindrical can body by a lid engaging portion of the cylindrical closure. Because of the arrangement described, rigidity is provided to the lip of the can body, the engaging collar results in a better drinking surface, and the cylindrical closure protects the drinking surface of the engaging collar prior to use thereof. Finally, due to the combination, the can body and can lid are formed of standard parts in a conventional and known manner.

43 Claims, 6 Drawing Sheets

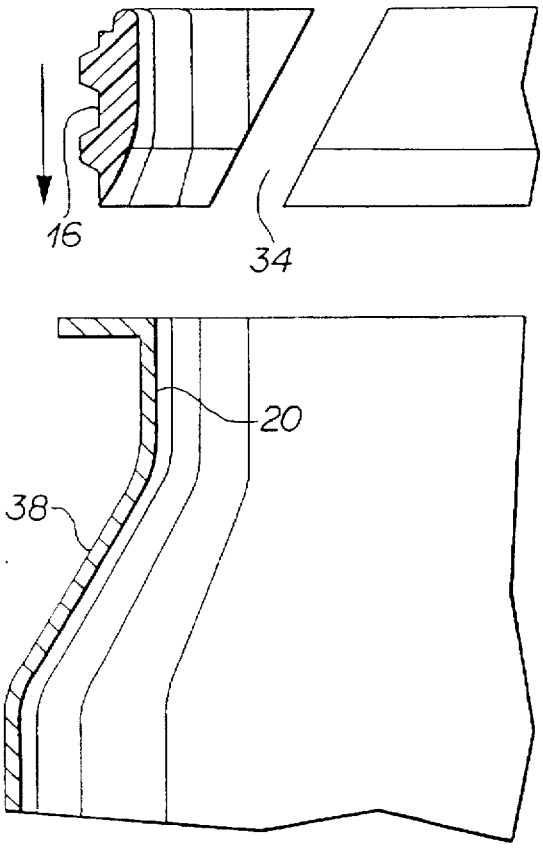
FIG 4A
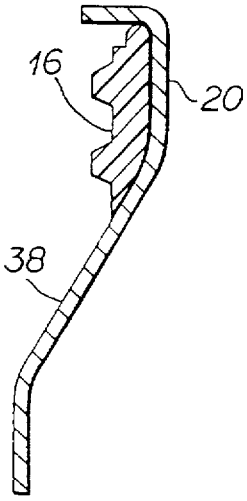
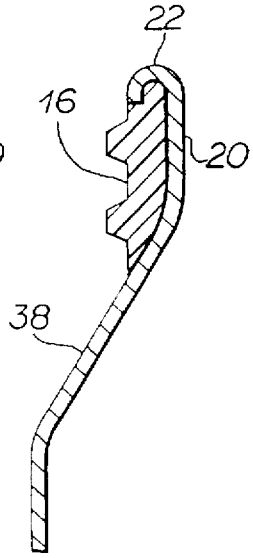
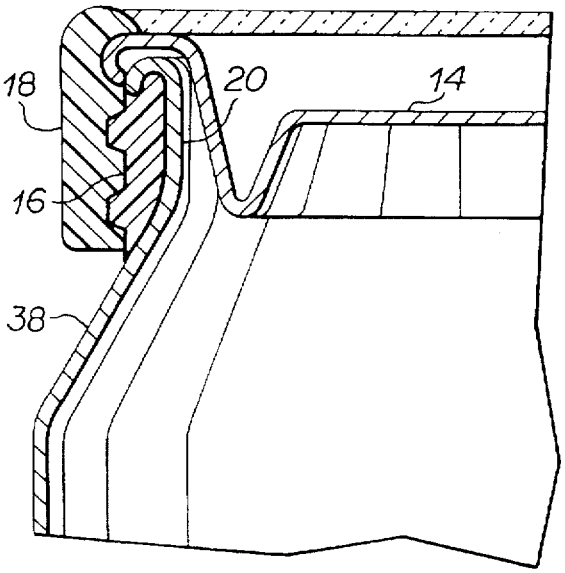
FIG 4B FIG 4C FIG 4D

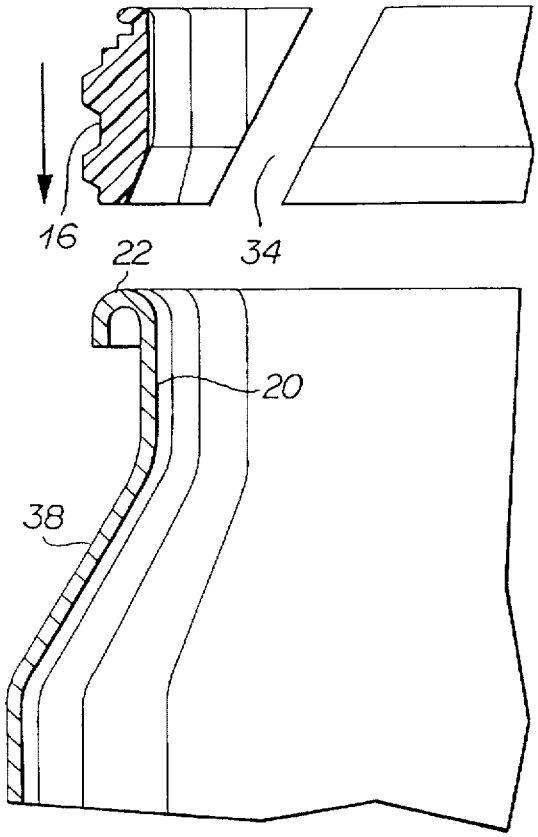
FIG 5A
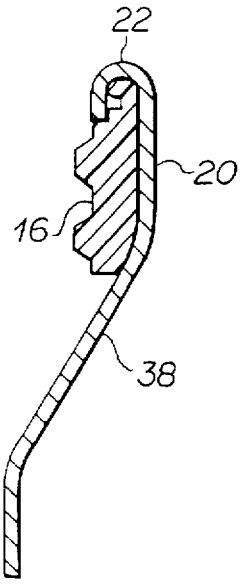
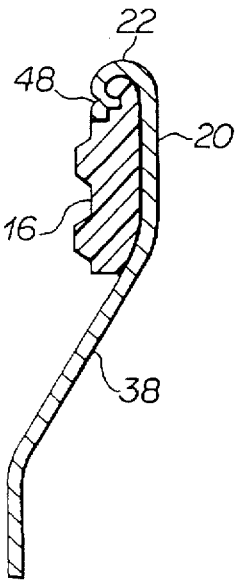
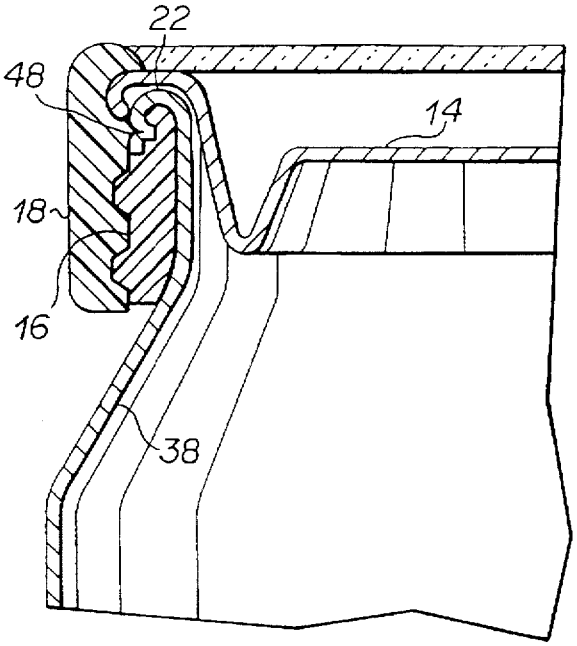
FIG 5B FIG 5C FIG 5D

TWIST-OFF CAN END

BACKGROUND OF THE INVENTION

1. Field of the Invention

The present invention relates to a twist-on/twist-off, resealable assembly for an existing can end, such as a metal can used in the beverage industry. More specifically, the present invention relates to a resealable can end assembly which is easy to open and reseal by twisting of the closure on the can end.

2. Description of Related Art

Current can ends for beverage cans are generally of the "ring-pull" or "press-down-stay-on-tab" type and have some disadvantages.

Generally, the cans known in the art are not resealable. The tabs are difficult to open and the opening size/shape is not ideal for drinking. Furthermore, the beverage product is not visible through the can end.

Most current can ends for beverages are aluminum, and since these are joined to the can body by roll seaming, recycling is more difficult when using steel body cans because the aluminum can end rolled to the steel can body must be separated for recycling. The design of a can end which is either less firmly attached to the body, or easily produced from either steel or aluminum, would be environmentally friendlier by enabling single material packages.

Finally, designs of can ends which enable easy inclusion of a hidden gift, or other promotional material, which is only accessible when the can is open, would give significant promotional advantages in the market place, compared with current can ends.

SUMMARY OF THE INVENTION

Accordingly, it is an object of this invention to provide can end systems, which are resealable, applicable to existing cans and can ends without retooling, easy-open, easy-drink; and which enables single metal can systems and hidden gift promotional possibilities.

The foregoing and other objects of this invention are fulfilled by providing a twist-off can end assembly, comprising:

a cylindrical can body having an open end and a closed end with a rolled flange extending around the exterior surface of the can body at the open end and a sloped shoulder portion joining the open end with side walls of the cylindrical can;

a collar surrounding the exterior surface of the can adjacent the open end, said collar including a can mating finish on an inner surface thereof and a closure engaging finish on an outer surface thereof, said collar being seated against the exterior surface of the open end between the rolled flange and the sloped shoulder portion of said can body; and a cylindrical closure having a lid portion and a depending peripheral skirt for operatively engaging the closure engaging finish of said collar;

the respective configurations of said closure at a distal edge thereof and an outer peripheral surface of the rolled flange being so shaped such that forces therebetween increase in response to an increase of pressure of contents within the can body, thereby increasing a hermetic seal of the closure to the open end of the can body.

The can end assembly will further include a pilfer-proof ring detachably secured to a bottom end of the skirt of the cylindrical closure and can further include a pull-tab formed in the lid portion. The can assembly may further comprise a resilient sealing member formed between the closure and the rolled flange portion of the can end.

Alternative embodiments provide for the closure engaging finish of the collar to be a threaded finish for engagement with corresponding threads in the depending peripheral skirt of the cylindrical closure or otherwise include lugs formed in the surface of the collar for engagement with corresponding recesses in the depending peripheral skirt of the cylindrical closure. The cylindrical closure including the lid portion is resealable on the end of the cylindrical can. Further embodiments include the use of a collar formed of a plastic material which is either a continuous band slidable over the open end of the can body prior to forming the rolled flange or a split ring for application to the open end of the can body subsequent to forming the rolled flange.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein:

FIGS. 4A–4D illustrate an optional embodiment in which a split plastic collar fits over a lip of the can end prior to seaming of the can end;

FIGS. 5A–5D show a further alternative embodiment utilizing a split collar crimped to the can end;

DETAILED DESCRIPTION OF PREFERRED EMBODIMENTS

Figure 1:
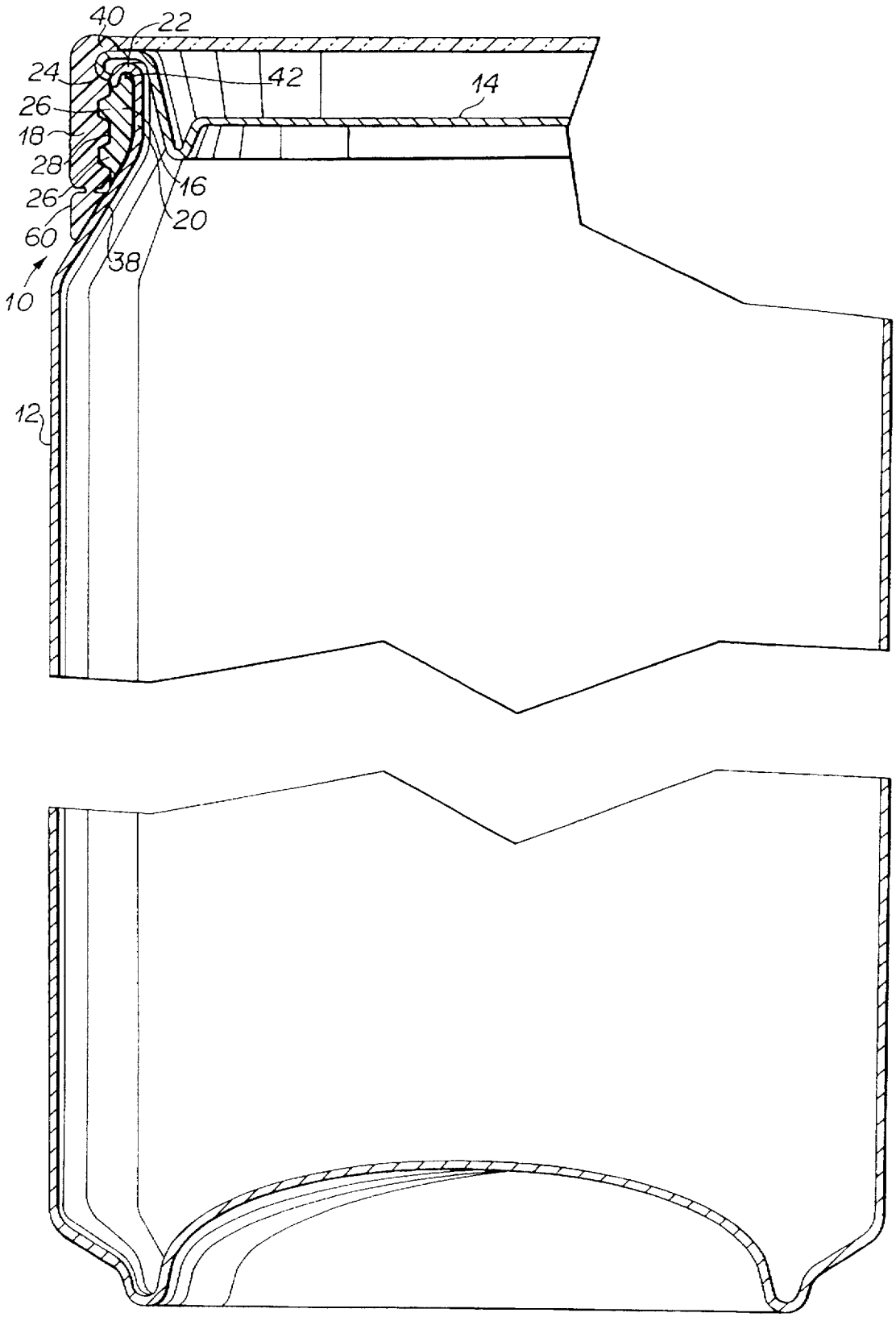
FIG. 1 is a side view, partially in section of a first embodiment of the present invention showing the twist-off can end assembly.

Referring in general to FIG. 1, there is shown a cylindrical can 10 for use in the present invention which includes a metal can body 12, a metal can lid 14, and an engaging collar 16 surrounding an end 20 of the can body 12. The engaging collar 16 shown in FIG. 1 includes outer threads 26 formed thereon and is shaped to include an upper peripheral lug member 42 on an end thereof which engages with a rolled flange 22 of the can end 20.

A cylindrical closure 18 includes an engaging surface such as inner threads 28 which mate with outer threads 26 formed on the engaging collar 16. One end of the cylindrical closure 18 includes a lid engaging portion 40 to be further described hereinbelow.

The lid member 14 is generally formed of metal and includes a substantially planar lid portion and a rolled lip 24 at a periphery thereof. The rolled lip 24 is such that the same may be snap-fit within the lid engaging portion 40 of the cylindrical closure member 18 as shown in FIG. 1 of the drawings.

The threaded engagement of the cylindrical closure 18 with the engaging collar 16 having the rolled lip 24 of the lid 14 snap-fit within the lid engaging portion 40 is such that a distal edge of the rolled lip 24 is in proximity to or abuts against an exterior surface of the rolled flange 22. Because of the cooperation of the distal edge of the rolled lip 24 with the exterior surface of the rolled flange 22, pressure within the can will not escape through the sealed lid. In particular, the rolled flange 22 is prevented from extending or straightening to a vertical position due to the abutment thereagainst by the distal edge of the rolled lip 24. The security of this engagement is at least 90 p.s.i., similar to the pressure within a conventional can having a rolled can end and conventional lid.

Figure 2:
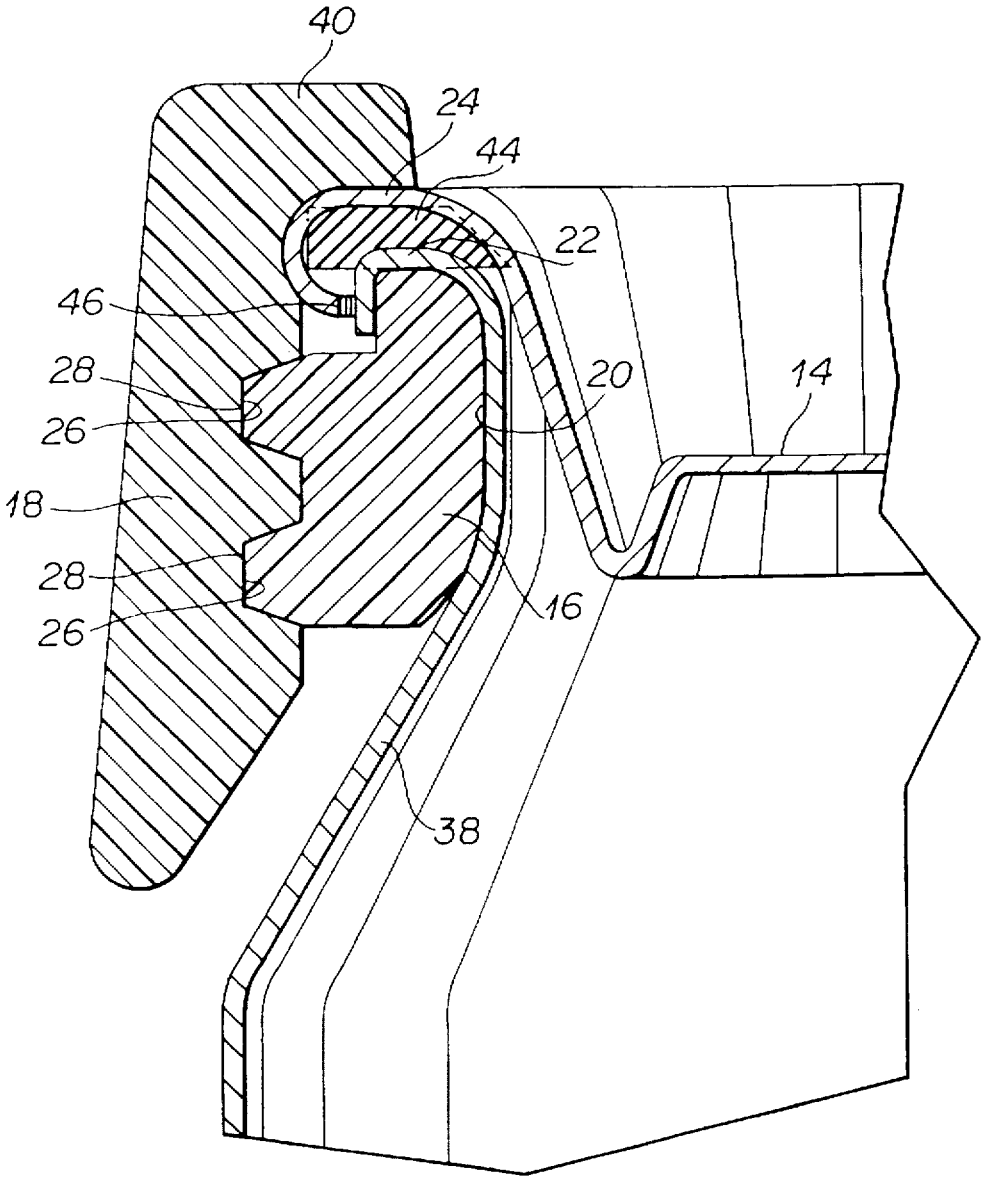
FIG. 2 is a side sectional view of a closure engagement shown in FIG. 1 with a resilient sealing member.

Referring further to FIG. 2, there is shown a gasket member 44 interposed between the rolled lip 24 and the rolled flange 22 in order to enhance the seal. It should be understood that the gasket member 44 will be present in all embodiments, however, it is only being shown in FIG. 2 due to the enlargement of that figure. As evident from the illustration in FIG. 2, the actual threaded portion may vary, so long as the finishes on the engaging ring and the cylindrical closure correspondingly mate with each other. The gasket 44 shown in FIG. 2 is of a generally trapezoid shape, however any suitable shape may be utilized for the same.

Figure 3A:
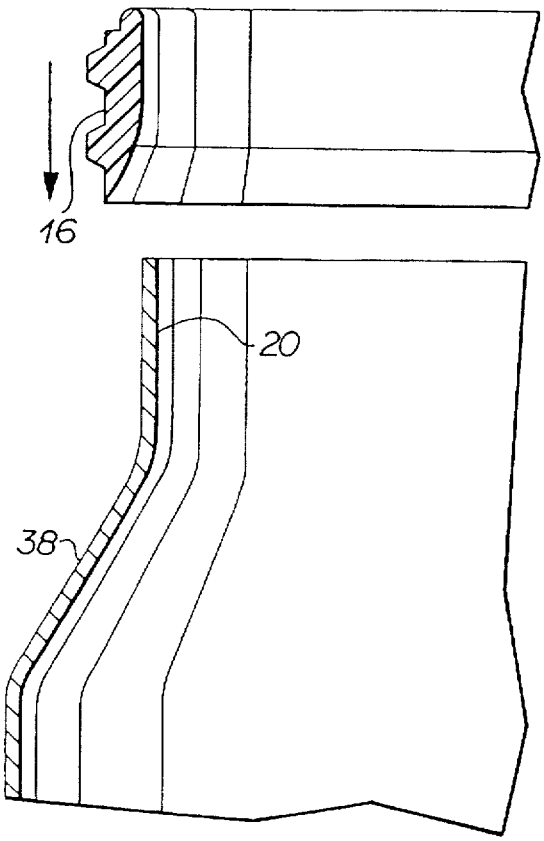
FIGS. 3A–3D show the assembly of a continuous plastic collar with a threaded finish over an end of the aluminum can prior to seaming the can end.
Figure 3B:
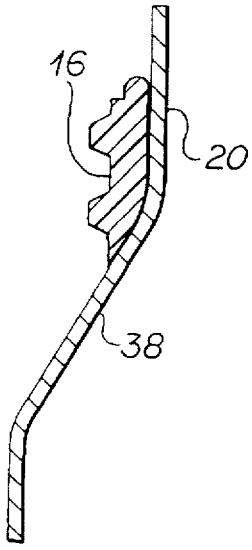
Figure 3C:
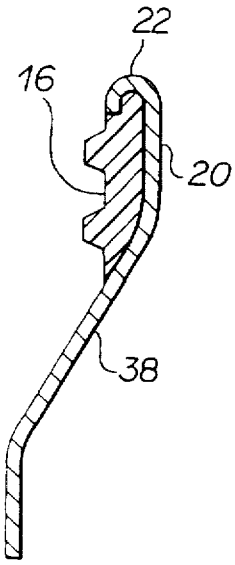
Figure 3D:
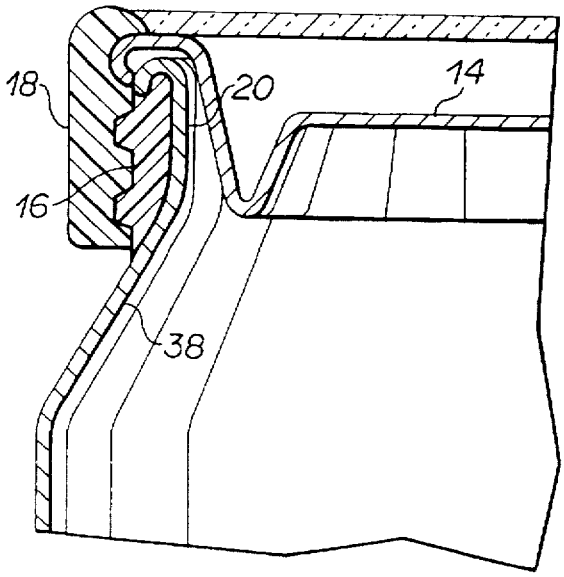

Referring now to FIGS. 3A–3D, there is generally shown the application of a continuous plastic ring or engaging collar 16 over the can end 20. The can end 20 is then rolled to form the rolled flange end 22 as shown in FIG. 3C. Such an engagement of the rolled flange 22 with the threaded engaging collar 16 grips the collar 16 between the rolled flange end 22 and a shoulder 38 of the can. As shown finally in FIG. 3D, the cylindrical closure 18 and aluminum lid 14 seal to the rolled flange end 22, thereby securing the contents in the can.

With regard to FIGS. 4A–4D, there is shown an alternative embodiment in which a plastic collar 16 split at 34 may be utilized when the end of the can 20 is preformed to be transverse to the longitudinal axis of the can in the forming process. As shown in FIG. 4B, due to the split nature of the collar 16 at 34, it is possible to surround the can end 20 with the collar 16 even though the distal edge of the can is formed at an angle with respect to the can end 20. As shown in FIG. 4C, the end of the can is then rolled at 22 to secure the collar 16 against the shoulder 38 of the can end 20. Finally, with regard to FIG. 4D, the closure 18 engages with the engaging collar 16 to secure the lid 14 against the rolled flange 22.

Referring now to FIGS. 5A–5D, the collar 16 split at 34 may also be utilized to fit over a 180° lip and then slid back up under lip 22, the rolled flange 22 being crimped at 48 against the engaging collar 16 as shown in FIGS. 5C and 5D. Application of the cylindrical closures 18 is similar to the embodiments described above. The embodiment shown in FIGS. 5A–5D is known to minimize a fracture of any varnish applied to the seal area.

Figure 6:
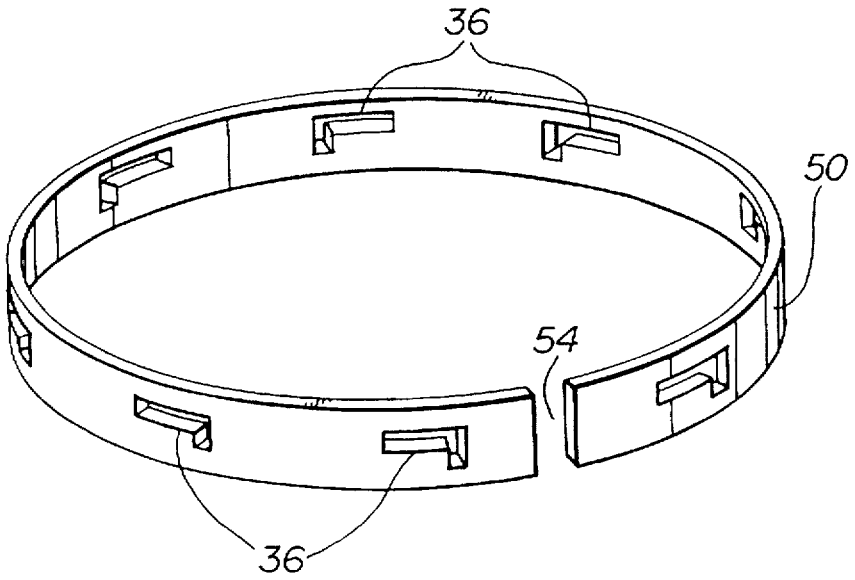
FIG. 6 is a perspective view of a split collar including engaging lugs formed therein.

FIG. 6 is a perspective view showing an alternative embodiment of a split ring 50, the split occurring at element 54. The split ring 50 is split to expand for fit over an aluminum flange, similar to that described above in connection with the embodiments shown in FIGS. 4A–4D, and FIGS. 5A–5D. Also shown in connection with FIG. 6 is an alternative to the threaded finish 26 shown in the first embodiment. In particular, a plurality of spaced lugs or cams 36 may be formed in the engaging collar on an outer peripheral surface thereof for engagement with corresponding recesses on an inner peripheral surface of the cylindrical closure in order to engage the two parts with each other.

Figure 7:
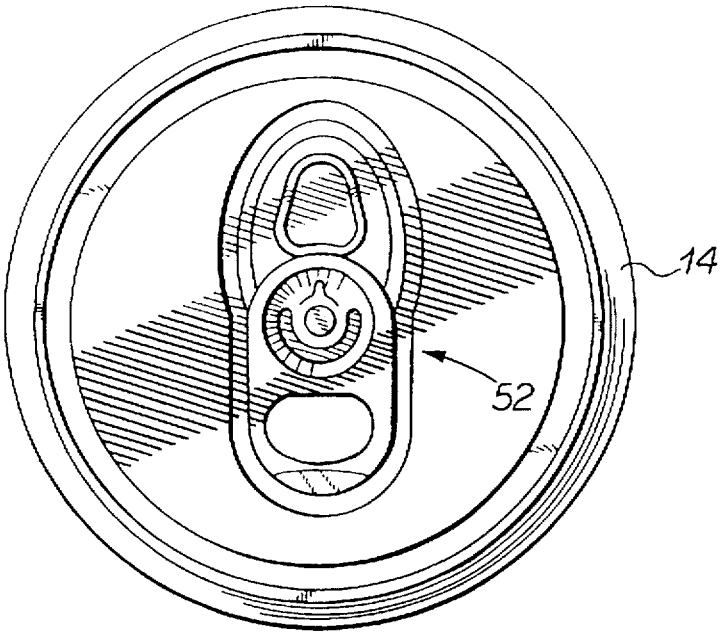
FIG. 7 is a top plan view showing a pull-tab for use in a can end of the present invention.

Referring finally to FIG. 7, there is shown a pull-tab 52 which may be utilized in the can lid 14 of the present invention to provide an optional drinking opening for the consumer. Thus, it is possible to either utilize the twist-off feature of the can end assembly or alternatively utilize a pull-tab for consuming the contents of the can.

The engaging collar 16 surrounding the exterior surface of the can is also advantageous for stiffening the end of the can. It is possible to glue the engaging collar to the can end in addition to the gripping which occurs via the rolled flange 22 and/or crimping at 48.

Upon applying the can end assembly to the can, the engaging collar 16 will turn further than the can lid 14 when sealing since the snap-fit of the rolled lip 22 is within the engaging portion 40. Thus, the lid will independently rotate relative to the engaging portion 40, thereby increasing the seal which will occur between the can lid 14 and the rolled flange 22 of the can end 20. In other words, accomplishment of a seal between the lid 14 and the rolled flange 22 does not impede further rotation of the closure 18 with respect to the collar 16. Absent such an independent rotation of the lid 14 within the engaging portion 40, it would be difficult to obtain a seal tighter than that permitted by the simple connection between the lid 14 and the rolled flange 22. This is particularly important when a resilient sealing member such as gasket 44 is positioned between the lid 14 and the rolled flange 22, since a resilient material will "grab" even more quickly due to presence of the gasket 44.

When using the gasket as at 44, it is possible to use a thicker gasket in order to increase the seal between elements.

Accordingly, when the cylindrical closure 18 including a lid member 14 snap-fit therein is removed from the can end, the consumer can drink a product from the can similar to drinking from a glass. It is then possible to reseal the can, if desired. With the top remaining in place, the consumer can open the pull-tab and drink from the can in the usual manner.

In addition to providing rigidity to the lip of the can body, the engaging collar 16 results in a better drinking surface and the cylindrical closure 18 protects the drinking surface of the engaging collar prior to use thereof.

Because of the unique combination as described above, the can body and can lid can be formed of standard parts in a conventional and known manner.

As an option, the cylindrical closure may include a pilfer-proof ring 60 similar to that used on plastic bottles. Such a ring is shown by way of example in FIG. 1, but it should be understood that the pilfer-proof ring 60 is available for all embodiments.

It should also be understood that either of the engaging collar 16 or the cylindrical closure 18 may be made of plastic or other suitable material, depending upon manufacturing constraints.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A twist-off can end assembly, comprising:

a cylindrical can body having an open end and a closed end with a rolled flange extending around an exterior surface of the can body at the open end and a shoulder portion joining the open end with side walls of the cylindrical can;

a collar surrounding the exterior surface of the can adjacent the open end, said collar including a can mating finish on an inner surface thereof and a closure engaging finish on an outer surface thereof, said collar being seated against the exterior surface of the open end between the rolled flange and the shoulder portion of said can body;

a closure having a lid portion and a depending peripheral skirt for operatively engaging the closure engaging finish of said collar; and means for increasing a hermetic seal of the closure to the open end of the can body, the means for increasing including the respective configurations of said closure at a distal edge thereof and an outer peripheral surface of the rolled flange being so shaped such that forces therebetween increase in response to an increase of pressure of contents within the can body.

2. The can end assembly according to claim 1, further comprising a pilfer-proof ring detachably secured to a bottom end of the skirt of said closure.

3. The can assembly according to claim 1, further including a pull-tab formed in said closure.

4. The can assembly according to claim 1, further comprising a resilient sealing member formed between said closure and the rolled flange portion of said can end.

5. The can assembly according to claim 1, wherein the closure engaging finish of said collar is a threaded finish for engagement with corresponding threads in the depending peripheral skirt of said closure.

6. The can assembly according to claim 1, wherein the closure engaging finish of said collar includes lugs formed in the surface thereof for engagement with corresponding recesses in the depending peripheral skirt of said closure.

7. The can assembly according to claim 1, wherein said collar is a continuous band slidable over the open end of said can body prior to forming the rolled flange.

8. The can assembly according to claim 1, wherein said collar is split for application to the open end of said can body subsequent to forming the rolled flange.

9. The can end assembly according to claim 1, wherein the can body is a beverage can body and wherein the seal between the closure and the can body is sufficient to withstand forces normally generated within a beverage container.

10. The can end assembly according to claim 1, wherein the depending peripheral skirt of the closure includes a lid engaging portion and wherein the lid portion of the closure includes a lid member, the lid member being secured to the open end of said cylindrical can body by the lid engaging portion of said closure.

11. The can assembly according to claim 10, wherein said closure portion is formed of a plastic material.

12. The can assembly according to claim 10, wherein the lid member is formed of metal material.

13. The can assembly according to claim 10, wherein said lid member snap-fits within the lid engaging portion of said closure.

14. The can assembly according to claim 10, wherein said lid engaging portion is formed of a plastic material.

15. A twist-off can end assembly, comprising:

a cylindrical can body having an open end and a closed end with a rolled flange extending around an exterior surface, of the can body at the open end and a shoulder portion joining the open end with side walls of the cylindrical can;

a collar surrounding the exterior surface of the can adjacent the open end, said collar including a can mating finish on an inner surface thereof and a closure engaging finish on an outer surface thereof, said collar being seated against the exterior surface of the open end between the rolled flange and the shoulder portion of said can body;

a cylindrical closure having a depending peripheral skirt for operatively engaging the closure engaging finish of said collar; and a lid member secured to the open end of said cylindrical can body by a lid engaging portion of said cylindrical closure, said lid member including a rolled lip at an outer peripheral edge with a distal edge of the rolled lip abutting against an exterior peripheral surface of the rolled flange.

16. The can end assembly according to claim 15, further comprising a pilfer-proof ring detachably secured to a bottom end of the skirt of said cylindrical closure.

17. The can assembly according to claim 15, further including a pull-tab formed in said lid member.

18. The can assembly according to claim 15, further comprising a resilient sealing member formed between said lid member and the rolled flange portion of said can end.

19. The can assembly according to claim 15, wherein said cylindrical closure is formed of a plastic material.

20. The can assembly according to claim 15, wherein said lid member is formed of metal material.

21. The can assembly according to claim 15, wherein the closure engaging finish of said collar is a threaded finish for engagement with corresponding threads in the depending peripheral skirt of said cylindrical closure.

22. The can assembly according to claim 15, wherein the closure engaging finish of said collar includes lugs formed in the surface thereof for engagement with corresponding recesses in the depending peripheral skirt of said cylindrical closure.

23. The can assembly according to claim 15, wherein a combination of said cylindrical closure and said lid member are resealable on the end of said cylindrical can.

24. The can assembly according to claim 15, wherein said lid member snap-fits within the lid engaging portion of said cylindrical closure.

25. The can assembly according to claim 15, wherein said collar is formed of a plastic material.

26. The can assembly according to claim 15, wherein said collar is a continuous band slidable over the open end of said can body prior to forming the rolled flange.

27. The can assembly according to claim 15, wherein said collar is split for application to the open end of said can body subsequent to forming the rolled flange.

28. The can end assembly according to claim 15, wherein the can body is a beverage can body.

29. A twist-off can end assembly, comprising:

a cylindrical can body having an open end and a closed end with a rolled flange extending around an exterior surface of the can body at the open end and a shoulder portion joining the open end with side walls of the cylindrical can;

a collar surrounding the exterior surface of the can adjacent the open end, said collar including a can mating finish on an inner surface thereof and a closure engaging finish on an outer surface thereof, said collar being seated against the exterior surface of the open end between the rolled flange and the shoulder portion of said can body;

a cylindrical closure having a depending peripheral skirt for operatively engaging the closure engaging finish of said collar; and a lid member secured to the open end of said cylindrical can body by a lid engaging portion of said cylindrical closure, said lid member being independently rotatable with respect to said cylindrical closure within the lid engaging portion such that establishment of a seal between said lid member and said rolled flange does not impede further rotation of said cylindrical closure on said collar, said lid member including a rolled lip at an outer peripheral edge with a distal edge of the rolled lip abutting against an exterior peripheral surface of the rolled flange.

30. The assembly according to claim 29, wherein the respective configurations of said lid member at a distal edge thereof and an outer peripheral surface of the rolled flange are so shaped that a force therebetween increases in response to an increase of pressure of contents within the can body, thereby increasing a hermetic seal of the lid to the open end of the can body.

31. The can end assembly according to claim 29, further comprising a pilfer-proof ring detachably secured to a bottom end of the skirt of said cylindrical closure.

32. The can assembly according to claim 29, further including a pull-tab formed in said lid member.

33. The can assembly according to claim 29, further comprising a resilient sealing member formed between said lid member and the rolled flange portion of said can end.

34. The can assembly according to claim 29, wherein said cylindrical closure is formed of a plastic material.

35. The can assembly according to claim 29, wherein said lid member is formed of metal material.

36. The can assembly according to claim 29, wherein the closure engaging finish of said collar is a threaded finish for engagement with corresponding threads in the depending peripheral skirt of said cylindrical closure.

37. The can assembly according to claim 29, wherein the closure engaging finish of said collar includes lugs formed in the surface thereof for engagement with corresponding recesses in the depending peripheral skirt of said cylindrical closure.

38. The can assembly according to claim 29, wherein a combination of said cylindrical closure and said lid member are resealable on the end of said cylindrical can.

39. The can assembly according to claim 29, wherein said lid member snap-fits within the lid engaging portion of said cylindrical closure.

40. The can assembly according to claim 29, wherein said collar is formed of a plastic material.

41. The can assembly according to claim 29, wherein said collar is a continuous band slidable over the open end of said can body prior to forming the rolled flange.

42. The can assembly according to claim 29, wherein said collar is split for application to the open end of said can body subsequent to forming the rolled flange.

43. The can end assembly according to claim 29, wherein the can body is a beverage can body.

* * * * *